United States Patent [19]

Luers et al.

[11] 4,315,543

[45] Feb. 16, 1982

[54] SEAL SYSTEM FOR WELLHEAD ISOLATION TOOL DIFFUSER

[75] Inventors: Thomas J. Luers; Richard L. Giroux, both of Duncan, Okla.

[73] Assignee: Halliburton Company, Duncan, Okla.

[21] Appl. No.: 65,654

[22] Filed: Aug. 10, 1979

[51] Int. Cl.[3] ..... E21B 33/126

[52] U.S. Cl. ..... 166/202; 277/212 C

[58] Field of Search ..... 166/202; 417/555; 92/241, 254; 277/212 C

[56] References Cited

U.S. PATENT DOCUMENTS

| | | | |
|---|---|---|---|
| 274,061 | 3/1883 | Voglesong | 277/212 C |
| 2,340,466 | 2/1944 | Gosling | 277/212 C |
| 2,352,700 | 7/1944 | Ferris | 166/202 |
| 2,482,651 | 9/1949 | Burt | 166/202 |
| 2,856,004 | 10/1958 | Badger | 166/202 |
| 3,002,562 | 10/1961 | Carothers | 166/202 |
| 3,830,304 | 8/1974 | Cummins | 16/305 R |
| 4,023,814 | 5/1977 | Pitts | 166/202 |
| 4,111,261 | 9/1978 | Oliver | 166/86 |

*Primary Examiner*—James A. Leppink

*Attorney, Agent, or Firm*—Joseph A. Walkowski; John H. Tregoning

[57] ABSTRACT

A seal system for a wellhead isolation tool diffuser utilizing elastomeric cup-shaped seals installed on the exterior of the diffuser, which is inserted into the production tubing at the wellhead. After insertion of the diffuser, the production tubing is pressurized, and the seals are set against the interior of the production tubing by the pressure in the well, effecting a tight seal.

13 Claims, 3 Drawing Figures

SEAL SYSTEM FOR WELLHEAD ISOLATION TOOL DIFFUSER

BACKGROUND OF THE INVENTION

It often becomes desirable when producing an oil well, to treat the well to enhance and increase flow, such as by applying an acidic solution to the producing formation under pressure or by applying a hydraulic solution to the formation under extremely high pressure in order to fracture the formation. In the past, it was necessary to "kill" the well by pumping a fluid, typically mud or water, into the well until sufficient hydrostatic pressure was obtained to overcome the pressure of the formation and prevent the blowing out of fluids from the well. The wellhead was then removed, and the necessary treating apparatus tied into the production tubing. After treatment, the well then had to be swabbed to re-institute production. This cumbersome process is superceded by a wellhead isolation system disclosed in U.S. Pat. No. 3,830,304 entitled "Wellhead Isolation Tool and Method of Use Thereof," issued to Alonzo E. Cummins and assigned to Halliburton Company, Duncan, Okla. The apparatus described therein provides means for directly communicating with production tubing without the removal of the wellhead, killing the well, or swabbing the well after treatment. This is accomplished by providing a hollow high pressure mandrel slidably engaged within a high pressure casing, the casing being adapted for sealing contact with the wellhead and the mandrel being adapted for selective sealing engagement with the upper end portion of the production tubing below the wellhead. The mandrel can be extended or retracted for engagement or disengagement with the production tubing without necessitating the removal of the wellhead. The treating fluids can then be supplied to the well through the mandrel directly into the production tubing of the well without subjecting the wellhead to the high pressures in the mandrel and production tubing. When the mandrel is extended in order to supply fluids to the well, the end of the mandrel is inserted within the production tubing. In order to maintain high pressure and flow rates when pumping sand-laden fracturing fluids through the previously described equipment into the production tubing, it is necessary to provide a seal means between the outer surface of the mandrel and the interior of the production tubing. Without such seal means, the wellhead is subjected to the high pressure of the treating fluid, which may cause damage to or even destroy the wellhead. Several methods of sealing the annulus between the outer surface of the mandrel and the inner surface of the production tubing have been employed.

U.S. Pat. No. 3,830,304, issued to Alonzo E. Cummins and referred to previously, discloses a seal collar at the lower end of the high pressure mandrel having an outwardly-flared sealing cup disposed about the end thereof. The sealing means is mechanically retained on the seal collar by axial pressure generated during assembly of the mandrel and collar. Above the sealing cup on the seal collar is located a secondary sealing means comprising an elastomeric ring, which is also mechanically retained by compression on the collar.

U.S. Pat. No. 4,023,814, issued to Charles A. Pitts and assigned to the Dow Chemical Company discloses a "packer cup assembly" similar to the seal collar of the above mentioned patent. An elastomeric sleeve extends downwardly beyond the end of the mandrel, and is flared outwardly to provide a seal between the mandrel and the interior wall of the production tubing when pressure is applied. The sleeve is bonded by bonding material to the metal of the mandrel.

U.S. Pat. No. 4,111,261, entitled "Wellhead Isolation Tool," issued to Owen Norman Oliver and assigned to Halliburton Company, Duncan, Oklahoma, discloses a seal collar spaced from the end of the high pressure mandrel, with an outwardly-flared sealing cup disposed about it. An elastomeric ring is provided above the cup as a secondary seal means. Both seal means are retained in place on the seal collar by axial compression generated by the assembly of the mandrel. A second sealing configuration is also described. In lieu of a sealing cup disposed about a seal collar, the cup, of an elastomeric material, is located at the extreme end of the mandrel and is molded and bonded thereto.

The disadvantages of the prior art apparatus are that the seal collars are difficult to insert in the well without damage to the cups, that known seal means utilizing a seal means with or without an additional gasket or ring does not provide an adequate seal, that seal means located at the very end of the higher pressure mandrel are susceptible to erosion and deterioration as a result of the fluid being pumped into the production tubing, and that the seal means of the prior art configuration necessitate relatively costly and complex manufacturing procedures with rigid quality control to assure an acceptable final product. In addition, the thickness of the prior art seals severely limits the inner diameter of the seal collar, promoting erosion, when fluid is pumped at high flow rates. Finally, the seal collars of the prior art must be discarded after a single use due to the aforementioned deterioration and the inability to replace the seals on the seal collars.

In contrast, the present invention overcomes the disadvantages and limitations of the prior art by providing an easily insertable seal collar, preferably referred to as a "guide nose," having a redundant, simple and easily replaceable effective sealing means, which can be assembled without bonding, forming or mechanical restraint of the sealing means on the guide nose. The present invention contemplates a guide nose for attachment to the lower end of a high pressure mandrel, the guide nose having a bore therethrough which has a diameter at its upper end equal to that of the mandrel bore, and a diameter at the lower end only slightly less than the interior diameter of the upper end portion of the oil well production tubing, the bore diverging between the upper and lower ends of the guide nose to provide a gradually enlarging bore therebetween. The guide nose possesses two circumferential grooves on its exterior, said grooves being spaced from the ends of the guide nose and from each other, for the installation of sealing means thereon. Each groove on said guide nose is double-stepped, that is to say that at each groove location the exterior of the guide nose has two different outside radii axially spaced from one another, with a third, different lesser outside radius therebetween, thus defining a groove. The higher of the two shoulders of each groove is at the upper edge of the groove, as the tool is oriented in the well, and the other is at the lower edge. Each sealing means installed at a groove location comprises an elastomeric sleeve in the shape of an inverted cup, as oriented in the well. The wall of each seal at its upper end is of a thickness substantially equal to the difference in radius between the bottom of a groove and the higher shoulder, the sleeve having an inner diameter substantially equal to that of the outside diameter of the guide nose at the location of the grooves; this configuration is maintained for an axial distance substantially equal to the width of the groove on the guide nose. The wall thickness of the remainder of each seal is substantially equal to the difference in radius between the higher and lower shoulders of a groove. This latter portion of the seal wall, however, is flared at an angle divergently outward from the axis of the seal, being formed in such a shape so as to contact the interior wall of the production tubing when the guide nose is inserted. The length of the flared or skirt portion of each seal is substantially equal to the axial length of a recess axially below each groove on the guide nose, the diameter of each recess being equal to that of the lower shoulders of the grooves. This permits the flared portion of the seal to be collapsed toward the axis of the guide nose during insertion into the production tubing, and aids the direction of high pressure fluid under the flared portion of the seal when the tubing is pressurized. The sealing means are installed on the diffuser at the groove locations, with the flared portion pointing downward, the thicker portion of each seal wall being retained in a groove by the elastomeric properties of the seal material and the mating configuration of the thicker portion of the seal wall and the groove. Upon insertion of the guide nose into the production tubing, and application of pressure to the well, the flared portions of the seal walls are pressed against the interior wall of the production tubing, effecting a fluid-tight seal.

DESCRIPTION OF THE PREFERRED EMBODIMENTS

Figure 1:
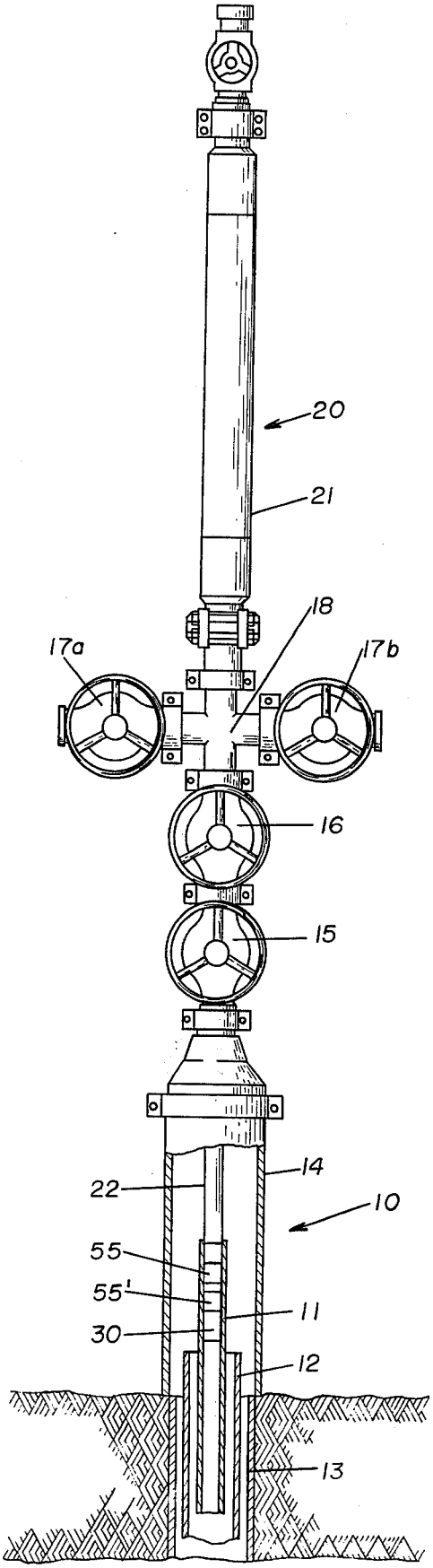
FIG. 1 illustrates a schematic drawing of a wellhead isolation tool after it has been actuated and the guide nose has been placed within the upper end of the production tubing.

Referring now to the drawings, and to FIG. 1 in particular, a normal producing well with wellhead isolation tool mounted thereon is schematically illustrated at 10. The well comprises casing 12 passing into the ground, ground casing 13 located concentrically around casing 12, and production tubing 11 passing concentrically within casings 12 and 13. Located above ground and mounted to ground casing 13, is the wellhead 14 having thereon a lower valve 15, intermediate valve 16, and a tee 18 including wing valves 17*a* and 17*b*. Mounted on the wellhead 14 is wellhead isolation tool 20 of the type disclosed in U.S. Pat. No. 3,830,304, referred to previously. The tool 20 comprises a tubular cylindrical housing 21 constructed of substantially strong material rated to withstand pressures in excess of 20,000 PSI. Located concentrically and slidably within housing 21 is a high pressure mandrel 22 which is a tubular cylindrical member extending completely through housing 21 above and below the housing. Attached to the lower end of mandrel 22 is guide nose 30 having thereon cup-shaped sealing means 55 and 55'.

Figure 2:
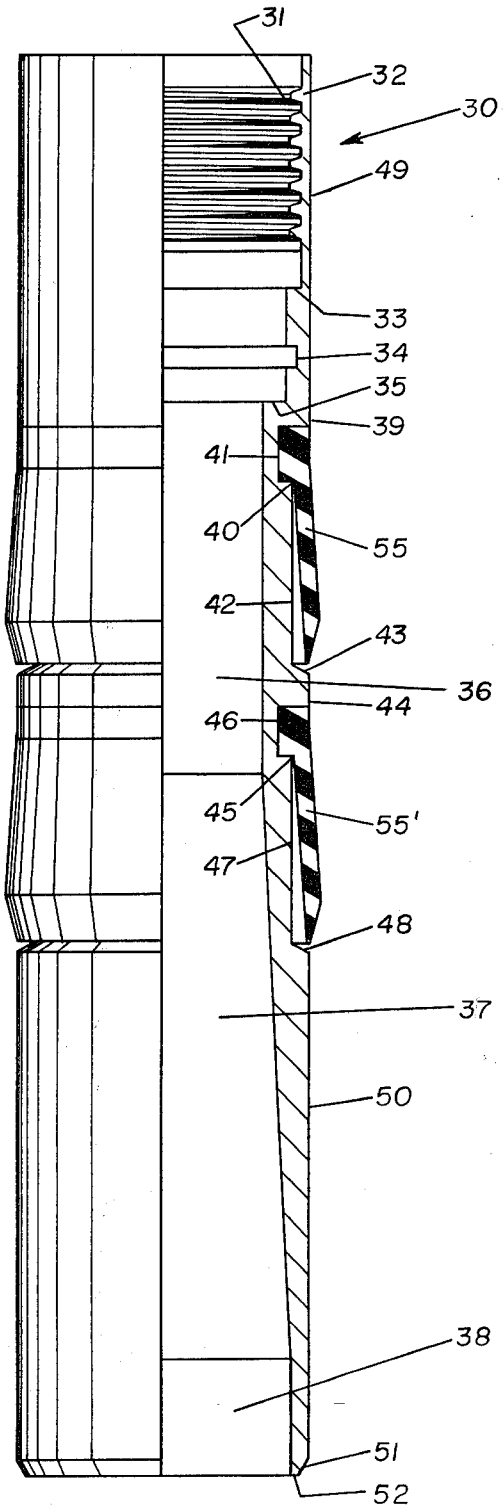
FIG. 2 is a partial cross-sectional view of the assembled guide nose and sealing means of the present invention.

Referring now to FIG. 2 of the drawings, a detailed description of the wellhead guide nose of the present invention is disclosed therein. Upper end portion 32 of guide nose 30 contains interior threads 31 for attachment to mandrel 22. Below threads 31 on the interior of guide nose 30 are located shoulders 33 and 35, against which corresponding mating portions of mandrel 22 abut when threadably attached thereto. Intermediate shoulders 33 and 35 is located annular groove 34, wherein an annular seal (not shown) is located to provide a fluid-tight seal between guide nose 30 and mandrel 23. The upper bore 36 of diffuser 30 is equal to that of mandrel 22, while the lower bore 38 of guide nose is only slightly less than the inner diameter of production tubing 11. Between upper bore 36 and lower bore 38 is located intermediate bore 37, which has a diameter equal to upper bore 36 at its upper end, and lower bore 38 at its lower end, the inner diameter of intermediate bore 37 diverging gradually and uniformly therebetween to define a frusto-conical surface.

The exterior of guide nose 30 has an upper outer surface 49 and a lower outer surface 50 of a diameter equal to that of mandrel 23. Between upper surface 49 and lower surface 50, the surface of guide nose 30 is grooved circumferentially so as to accommodate cup seals 55 and 55'. It should be noted that seals 55 and 55' are identical, whereby details of the composition and structure of seal 55 are equally applicable to and intended to be descriptive of the characteristics of seal 55'.

Figure 3:
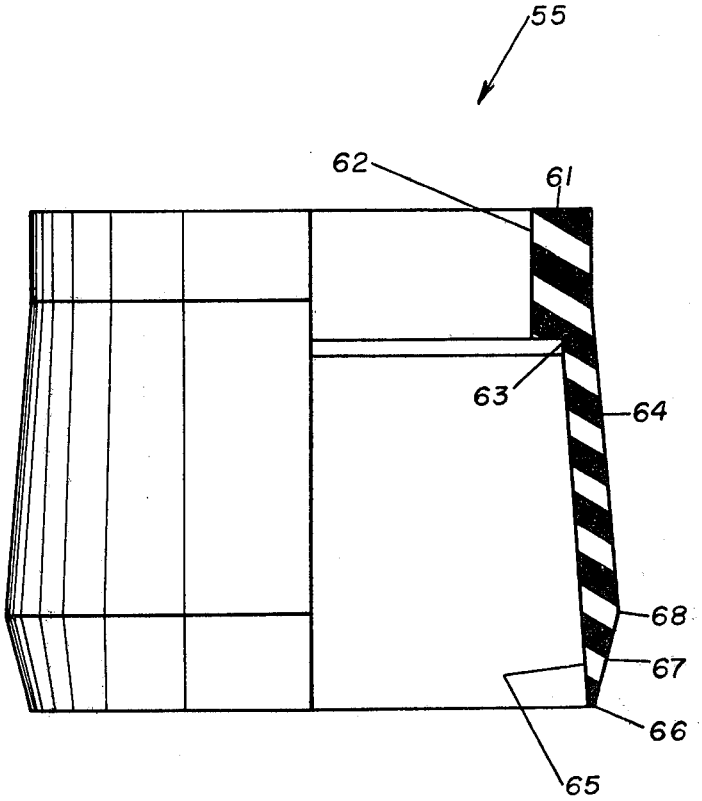
FIG. 3 is a partial cross-sectional view of an individual seal employed in the present invention.

Referring to both FIGS. 2 and 3, uppermost groove 41 accommodates cup seal 55 which is formed from an elastomeric material. Groove 41 is defined by upper shoulder 39 and lower shoulder 40. The radial distance between the edge of upper shoulder 39, which is contiguous with and of the same outer diameter as outer surface 49, and the bottom of groove 41 is substantially equal to the thickness of the upper wall 61 of cup seal 55. The width of groove 41, measured axially, is substantially equal to the axial length 62 of upper wall 61 of cup seal 55. The radial distance between the edge of lower shoulder 40 and the bottom of groove 41 is substantially equal to the difference between the thickness of upper wall 61 and lower wall 64 of cup seal 55. The mating configuration of groove 41 and upper wall 61, together with the elastomeric qualities of cup seal 55, ensure a tight, positive fit when cup seal 55 is stretched over outer surface 49 of diffuser 30 and the elastomeric material of upper wall 61 contracts into groove 41. Additionally, the double step design of groove 41 allows upper shoulder 39 to provide axial reinforcement to cup seal 55 where it is subjected to pressure from the well. Axially below and in communication with groove 41 on guide nose 30 is recess 42, of a radial depth substantially equal to the thickness of lower wall 64 of cup seal 55. The inner diameter of upper portion 63 of lower wall 64 of cup seal 55 is substantially equal to the outer diameter of guide nose 30 in the area defined by recess 42. This feature also aides in the mating of groove 41 with upper wall 61 and ensures a fluid-tight seal between cup seal 55 and diffuser 30. Lower wall 64 is of substantially equal axial length as recess 42, and is flared divergently from the axis of guide nose in a downward direction. Where lower portion 65 joins upper portion 63 of lower wall 64, the inner diameter of cup seal 55 remains substantially the same as the diameter of recess 42, thence diverging downwardly at a gradual and uniform angle to the axis of the cup, as mounted on the diffuser, the inner diameter of the extreme lower tip 66 of lower wall 65 being substantially equal to the diameter of outer guide nose surfaces 49 and 50. The exterior of the lower wall 64 of cup seal 55 is flared divergently outward at substantially the same angle as the interior, save at the end, where it converges toward the axis of the cup seal as shown at 67. At its widest point 68, lower wall 64 has a greater diameter than the inner diameter of production tubing 11. Axially below recess 42 on the outer surface of the guide nose, and contiguous therewith, is outwardly beveled surface 43, the upper, inner edge of which has a diameter equal to recess 42, and the lower, outer edge of which has a diameter equal to that of outer surfaces 49 and 50. Axially below and contiguous with beveled surface 43 is upper shoulder 44, which, like shoulder 39, is of equal diameter to outer surfaces 49 and 50. Upper shoulder 44 and lower shoulder 45 define groove 46 in the same manner as shoulders 39 and 40 define groove 41. The diameter of shoulder 44 is equal to that of shoulder 39, and the diameter of shoulder 45 is equal to that of shoulder 40. The radial distance between shoulders 44 and 45, respectively, and the bottom of groove 46 is the same as the radial distance between shoulders 39 and 40, respectively, and the bottom of groove 41. The width of groove 46, measured axially with respect to guide nose 30 is equal to that of groove 41, and the diameters of grooves 41 and 46 are equal. Recess 47, below and contiguous with groove 46 on the guide nose, is of equal diameter and length to recess 42. Outwardly beveled surface 48, axially below and contiguous with recess 47, is identical in shape and dimensions to beveled surface 43. Beveled surface 48 communicates with and joins recess 47 and outer surface 50 of guide nose 30. Cup seal 55', as noted previously and as shown in FIG. 2, is identical to cup seal 55, and is mounted in groove 46, oriented on guide nose 30 in the same manner as cup seal 55.

Below outer surface 50 of diffuser 30, inwardly beveled surface 51 communicates with end surface 52.

Referring now to FIGS. 1 and 2, operation of the apparatus will be described in more detail. As mandrel 23 is inserted into production tubing 11 by a downward movement, guide nose 30 is on the lower end of mandrel 22. Beveled surface 51 at lower end 52 facilitates the entry of guide nose 30 into tubing 11 by providing an angled surface which will tend to align the diffuser 30 concentrically within production tubing 11. After end 52 has entered the tubing 11, the mandrel 22 is further lowered until cup seals 55 and 55' are within tubing 11. Converging angled outer surfaces 67 of cup seals 55 and 55' facilitate insertion of the guide nose assembly, by tending to align cup seals 55 and 55' within the tubing. Due to the outer diameter at edges 68 of cup seals 55 and 55' being greater than the inner diameter of tubing 11, the insertion of the guide nose tends to compress the lower wall 64 of the cups, the elastomeric qualities of which tend to press said lower wall 64 outwardly against the interior of tubing 11, for a tight fit. The elastomeric qualities and divergent lower wall of cup seals 55 and 55' also tend to compensate for irregularities in the interior of tubing 11. If desired, fluid may be pumped into the tubing 11 along the outside of guide nose 30, thereby tending to collapse outer walls 64 of cup seals 55 and 55' into recesses 42 and 47, narrowing the diameter of the seals to that of the exterior guide nose 30 and facilitating insertion. After insertion of guide nose 30, well 10 is then pressurized by the introduction of fluid under high pressure through mandrel 22 into production tubing 11. Prior to the introduction of fluid into production tubing 11, cup seals 55 and 55' may be set against the walls of the production tubing 11 by release of pressure on the backside of the seals, effected by opening wing valve **17*a* or 17*b*. In any event, as the high pressure fluid is introduced into the tubing 11 below cup seals 55 and 55', the pressure within tubing 11 becomes greater than that inside of wellhead 14. The pressure differential results in fluid being moved upward between mandrel 22 and the inside of production tubing 11. The ends of divergent lower walls 64 of cup seals 55 and 55' are then forced outward tightly against the tubing wall. As the pressure forces the end of cup seals 55 and 55' against the tubing walls, the thicker upper walls 61 of the seals are held by grooves 41 and 46, and forced against upper shoulders 39 and 44 by the pressure in the production tubing. Thus, fluid-tight seals are effected at the junctions of the tubing wall and cup seals, and the cup seals and guide nose. Rapid outward expansion of the lower walls 64 of cup seals 55 and 55' is aided by beveled surfaces 43 and 48 in conjunction with recesses 42 and 47, which tend to direct the initial fluid flow under rather than over the lower walls 64**, which would tend to collapse them. It should be understood that the disclosure of plural seal cups is not to be construed as an indication that two cup seals are necessary for an effective fluid seal. In fact, an adequate seal can be effected by the use of one cup seal. Due to the possibility of damage in handling the guide nose prior to use, and of damaging a seal during insertion into the production tubing, and to the extremely high pressures encountered with the use of a wellhead isolation too, however, it is expedient to incorporate a redundant double-seal design into the guide nose to ensure a proper fluid seal under all conditions.

Thus it can be seen from the description of the construction, assembly and operation of the guide nose seal system that it possesses many new and different advantages over the prior art. The apparatus of the present invention is easily assembled from a minimum number of pieces. The manner in which the cup seals are mounted on the guide nose compels correct placement and orientation by virtue of the fact that the seals will only fit on the diffuser in one manner, thereby assuring quality control and avoiding the complex assembly methods heretofore employed in producing known seal systems. The cup seals are placed close enough to the end of the guide nose to ensure a practical mandrel and guide nose length and stroke, will spacing the cup seals from the end of the guide nose ensures that the beveled metal end of the guide nose will make the first, often abrupt contract with the end of the well production tubing. Moreover, the spacing of the seal cups from the end of the guide nose removes the likelihood of erosion and deterioration of the seal from exposure to the flow of fluid, which is often highly abrasive. The provision of recesses on the mandrel surface under the lower walls of the cup seals is advantageous to the insertion of the guide nose, as it allows the lower walls of the seals to collapse toward the guide nose to a greater degree so as to minimize the chance that the seals will be damaged or stripped off during insertion. The same recesses, in conjunction with the beveled lead-in surfaces at their lower edges, rapidly direct the fluid flow under the seal walls in a positive manner when the production tubing is pressurized, minimizing leakage and reducing the chance of the lower walls collapsing against the side of the guide nose. The groove configuration on the diffuser achieves a self-reinforcing effect heretofore unknown in the prior art, and eliminates bonding, molding or clamping seal elements to the guide nose. The aforementioned groove and recess design of the guide nose also permits a more thin-lined seal than heretofore known, the seal adding little or no diameter to the guide nose assembly as it is collapsed during insertion into the production tubing, being recessed into the exterior of the guide nose. A larger diameter guide nose is then practical for the same size production tubing, and the attendant inside diameter of the guide nose can be increased, allowing higher fluid flow rates with minimal damage to the guide nose and tubing. With the present invention, all other seal means are unnecessary, and the guide nose can be re-equipped with the slip-on cup seals for multiple uses, in contrast with the single-use capability of known seal collars. In all, the apparatus of the present invention provides a more positive, less failure-prone seal than the prior art, while being simpler and less costly to manufacture, assemble and use.

Although a specific preferred embodiment of the present invention has been described in the detailed description above, the description is not intended to limit the invention to the particular forms or embodiments disclosed herein since they are recognized as illustrative rather than restrictive, and it would be obvious to those skilled in the art that the invention is not so limited. For example, it would be obvious from this disclosure to form the guide nose as an integral part of the mandrel. Similarly, the effectiveness of the sealing means is not dependent on the bore configuration of the guide nose. Thus a straight rather than divergent bore may be employed. It would also be obvious to utilize only one seal cup, or a plurality of more than two, dependent upon the desired degree of redundancy. Thus, the invention is declared to cover all changes and modifications of the specific example of the invention herein disclosed for purposes of illustration, which do not constitute departures from the spirit and scope of the invention.

What is claimed is:

1. Seal means for a guide nose of a wellhead isolation tool, comprising:

a resilient, elastomeric seal in the form of an outwardly flared inverted cup having an opening therethrough, a relatively thick upper wall and a relatively thin lower wall; and a stepped circumferential groove in the exterior of said guide nose, said stepped circumferential groove having a deeper, axially upper portion and a shallower, axially lower portion, said upper wall fitting in mating engagement with said upper portion, and said lower wall extending over substantially the entire width of said lower portion.

2. In an apparatus for providing fluid communication between a source of high pressure fluid and the interior of the upper end portion of the production tubing of an oil well, while isolating the wellhead from said high pressure fluid, the apparatus being of the type which includes: elongated tubular housing means defining a bore therethrough for connection in fluid communication with the interior of the wellhead; elongated tubular mandrel means defining a bore therethrough, concentrically positioned within said elongated tubular housing means in movable sealing engagement therewith, a portion of said mandrel being adapted to extend below said elongated tubular housing means; means for moving said mandrel means within said elongated tubular housing means to extend said inner mandrel means downwardly through said elongated tubular housing means into said production tubing and alternately, to extend said mandrel means upwardly through said elongated tubular housing means; and guide nose means disposed at the lower end portion of the mandrel means having a bore therethrough axially aligned with that of said mandrel, the improvement comprising:

seal means disposed on said guide nose means, said seal means comprising a resilient seal in the form of an inverted cup having an opening therethrough and a relatively thick upper wall and a relatively thin lower wall; and a stepped circumferential groove in the exterior of said guide nose, said stepped circumferential groove having a deeper, upper portion of an axial width substantially equal to the axial length of said upper wall, and a shallower, lower portion of an axial width substantially the same as the axial length of said lower wall;

said upper wall of said resilient seal being in mating engagement with said deeper, upper portion of said stepped circumferential groove, and said lower wall of said resilient seal extending over said shallower, lower portion of said circumferential groove.

3. The apparatus of claim 2 wherein said seal means is spaced from the lower end of said guide nose.

4. The apparatus of claim 2 wherein said seal means further comprises a plurality of said resilient seals in mating engagement with a plurality of said grooves in the exterior of said guide nose.

5. The apparatus of claim 2 wherein said cup seal further comprises an elastomer.

6. The apparatus of claim 2 wherein the thickness of the upper wall of said cup seal and the depth of said deeper, upper portion of said circumferential groove are substantially equal.

7. The apparatus of claim 6 wherein the thickness of the lower wall of said cup is substantially equal to the depth of said shallower, lower portion of said circumferential groove.

8. The apparatus of claim 7 wherein said lower wall is flared divergently outward from the axis of said cup seal in a downward direction.

9. The apparatus of claim 8 wherein the outer diameter of said lower wall at a point near its lower end is greater than the inner diameter of said production tubing.

10. The apparatus of claim 9 wherein the exterior of said lower wall of said cup seal converges downwardly toward the axis of said cup seal from the point of its greatest outer diameter to the lowest edge of said lower wall.

11. The apparatus of claim 10 wherein the lowest edge of said lower wall of said cup seal has a diameter substantially equal to the maximum outer diameter of said guide nose.

12. The apparatus of claim 11, wherein said shallower, lower portion of said circumferential groove has at its lower extent an outwardly beveled surface which communicates with the exterior of said guide nose below said cup seal.

13. The apparatus of claim 12 wherein the inner diameter of the upper portion of said lower wall is substantially equal to the outer diameter of said shallower, lower portion of said circumferential groove.

* * * * *

UNITED STATES PATENT AND TRADEMARK OFFICE

CERTIFICATE OF CORRECTION

PATENT NO. : 4,315,543

DATED : February 16, 1982

INVENTOR(S) : Thomas J. Luers and Richard L. Giroux

It is certified that error appears in the above-identified patent and that said Letters Patent is hereby corrected as shown below:

In the Title, second line, change "DIFFUSER" to --MANDREL--

Column 6, line 30, change "too" to --tool--
Column 6, line 42, change "diffuser" to --guide nose--
Column 6, line 47, change "will" to --while--
Column 6, lines 66-67, change "diffuser" to --guide nose--

Signed and Sealed this

*Eleventh* Day of *January 1983*

[SEAL]

*Attest:*

GERALD J. MOSSINGHOFF

*Attesting Officer*

*Commissioner of Patents and Trademarks*